US008707479B2

(12) United States Patent
Benninger

(10) Patent No.: US 8,707,479 B2
(45) Date of Patent: Apr. 29, 2014

(54) SLEEPING BAG

(76) Inventor: Gary N. Benninger, West Bloomfield, MI (US)

( * ) Notice: Subject to any disclaimer, the term of this patent is extended or adjusted under 35 U.S.C. 154(b) by 0 days.

(21) Appl. No.: 13/549,997

(22) Filed: Jul. 16, 2012

(65) Prior Publication Data

US 2014/0013506 A1 Jan. 16, 2014

(51) Int. Cl.
*A47G 9/08* (2006.01)
*A41B 13/06* (2006.01)

(52) U.S. Cl.
USPC ..... 5/413 R; 5/413 AM; 2/69.5

(58) Field of Classification Search
USPC ..... 5/413 R, 413 AM, 494; 2/69.5, 84
See application file for complete search history.

(56) References Cited

U.S. PATENT DOCUMENTS

| | | | | | |
|---|---|---|---|---|---|
| 2,338,226 | A * | 1/1944 | Bauer | 5/413 R |
| 3,639,931 | A * | 2/1972 | McGuire | 5/413 R |
| 3,787,906 | A * | 1/1974 | Hunt | 5/413 R |
| 3,857,125 | A * | 12/1974 | Hunt | 5/413 R |
| 3,959,834 | A * | 6/1976 | Hunt | 5/413 R |
| 4,090,269 | A * | 5/1978 | Hunt | 5/413 R |
| 4,354,281 | A * | 10/1982 | Satoh | 5/413 R |
| 4,884,303 | A * | 12/1989 | Scherer | 5/413 R |
| 4,894,878 | A * | 1/1990 | Roach | 5/413 R |
| 4,910,055 | A * | 3/1990 | Wigutow | 428/36.1 |
| 4,989,282 | A | 2/1991 | Goldstein | |
| 5,473,779 | A * | 12/1995 | Kramer | 5/413 R |
| 5,490,294 | A * | 2/1996 | Kramer | 5/413 R |
| 5,657,497 | A * | 8/1997 | Howe | 5/413 R |
| 6,175,976 | B1 * | 1/2001 | Cantwell | 5/413 R |
| 6,334,221 | B1 | 1/2002 | Hope | |
| 6,449,787 | B1 * | 9/2002 | Thorne | 5/413 R |
| 6,931,680 | B2 * | 8/2005 | Bellick et al. | 5/413 R |
| 7,181,785 | B2 | 2/2007 | Dinan et al. | |
| 7,631,376 | B2 | 12/2009 | Peterson et al. | |
| 7,832,032 | B2 * | 11/2010 | Haislip | 5/413 R |
| 8,166,572 | B1 * | 5/2012 | Campbell et al. | 2/69.5 |
| 2007/0209114 | A1 * | 9/2007 | Chu | 5/413 AM |
| 2009/0255059 | A1 | 10/2009 | Ascroft et al. | |
| 2010/0192298 | A1 | 8/2010 | Michaelis et al. | |
| 2010/0299832 | A1 * | 12/2010 | Alford | 5/413 AM |
| 2011/0173749 | A1 * | 7/2011 | Martray | 5/413 R |
| 2012/0297539 | A1 | 11/2012 | Like et al. | |
| 2012/0317718 | A1 | 12/2012 | Wu | |

FOREIGN PATENT DOCUMENTS

EP 0 761 145 A2 3/1997

* cited by examiner

*Primary Examiner* — William Kelleher
*Assistant Examiner* — Eric Kurilla
(74) *Attorney, Agent, or Firm* — Dickinson Wright, PLLC

(57) ABSTRACT

A sleeping bag constructed such that its outer circumference is greater than its inner circumference includes additional integrated protuberances, or space fillers, that are added to the interior lining of the sleeping bag to fill-in around the sleeper's body. Making the circumference of the outside of the bag greater than the inside maintains the thickness of the insulation in selected areas. To maintain insulation thickness at other locations around the sleeper's body, the insulation-containing space fillers are incorporated into the interior of the bag and expand under the influence of the insulation to fill-in around the sleeper for reducing the internal volume of the bag. This construction can be carried the length of the sleeping bag.

7 Claims, 7 Drawing Sheets

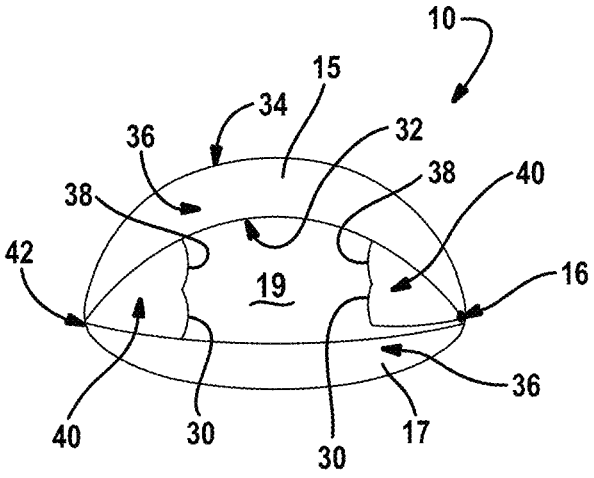
FIG. 2B
FIG. 2C
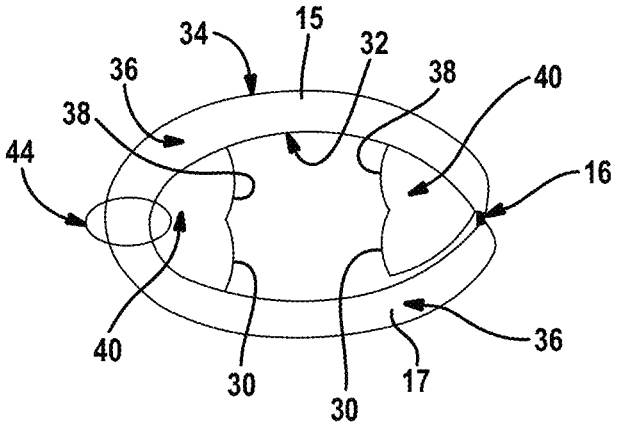
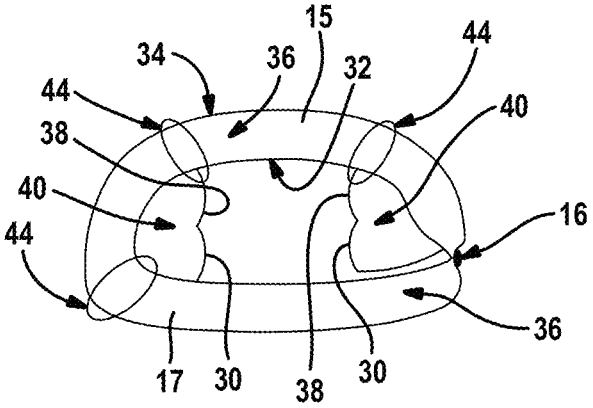
FIG. 2D

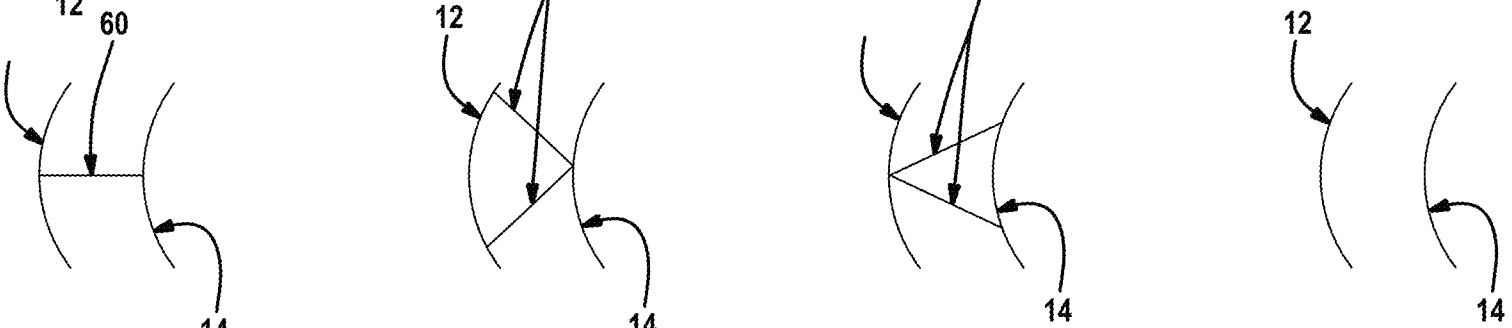
FIG. 4A
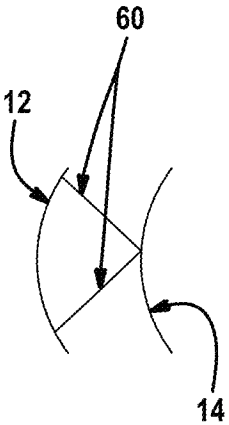
FIG. 4B
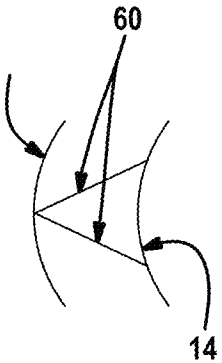
FIG. 4C
FIG. 4D

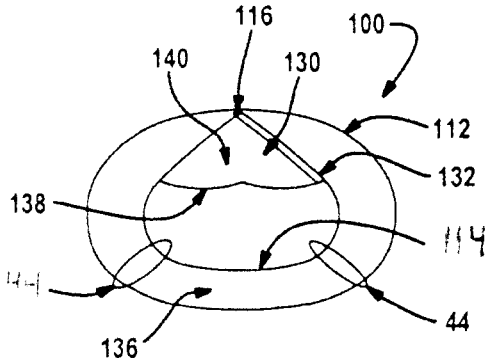
FIG. 7
FIG. 8A
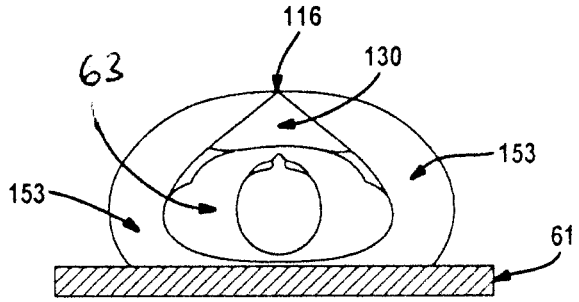
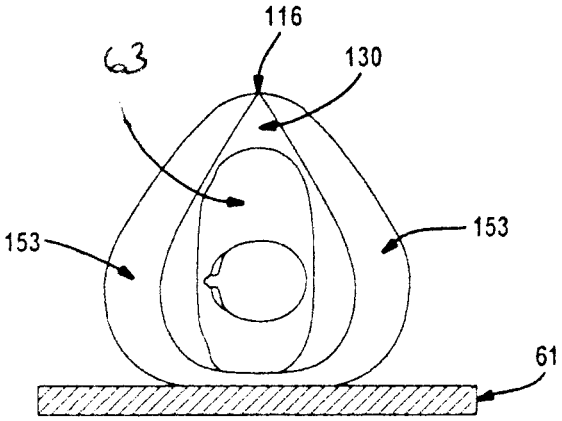
FIG. 8B

SLEEPING BAG

FIELD

The present disclosure relates generally to sleeping bags and, more particularly, to sleeping bags that combine an insulation-containing differential construction with insulation-containing internal space filler elements adapted to expand under the influence of the insulation for reducing the internal volume of the sleeping bag during use.

BACKGROUND

This section provides background information related to the present disclosure which is not necessarily prior art.

A sleeping bag typically includes first and second opposed halves defining a sleeping compartment therebetween and which are connected in such a way to define an entrance aperture at an entrance side or end of the sleeping bag. Each half of the sleeping bag includes an outer shell and an inner shell with an insulating material disposed and retained between these two layers. Insulation thickness depends on the minimum ambient air temperatures that are expected to be encountered by the user. Colder temperatures require a greater thickness of insulation to keep heat loss from the user sufficiently low enough that the user does not become uncomfortable. Sleeping bags come in several different physical configurations including, but not limited to, rectangular, semi-rectangular and mummy. In addition, some sleeping bags may incorporate an integral hood. Typically, sleeping bags have one or more closure devices, such as zippers, of a selected length to provide access to the entrance aperture and which can be located on the sides, ends or top to permit use of the sleeping bag.

Very lightweight, compressible insulation materials, such as water fowl down, are extremely desirable since they are able to provide sufficient insulation while being light weight and easily compressed. When used as an insulation material in sleeping bags, the down is easily compressed from the outside by the weight of the bag materials and from the inside by the user pushing outward. To assist in maintaining the insulation thickness and resist such compression, the sleeping bag can be constructed so that its outside circumference is greater than its inside circumference. This is a well-known sleeping bag construction and is normally referred to as "differential construction" or "differential cut". Commonly, the outer shell is connected to the inner shell by baffles that create compartments or tubes into which the insulating material is placed. A sleeping bag constructed in this fashion creates an arc of insulation over the user's body. However, the arc structure that is created by the differential construction has an undesirable feature. That is, the interior surface of the sleeping bag is held away from the user's body since the sleeping bag assumes the shape of the arc.

SUMMARY

It is an aspect of the present teachings to provide a sleeping bag that overcomes the undesirable features of prior art sleeping bags.

In accordance with this and other aspects, the present disclosure is directed to a differential construction type of sleeping bag which incorporates insulation containing compartments, or internal space fillers, that are strategically located laterally or above the user's body and can extend either partially or completely the full length of the sleeping bag within the sleeping compartment. These insulated space fillers are cut full so that they can, under the influence of the insulating material, expand inwardly to fill voids surrounding the user's body that may have been created as a result of the differential construction.

Further areas of applicability will become apparent from the description and claims herein. The description and specific examples in the disclosure and summary are intended for purposes of illustration only and are not intended to limit the scope of the present invention.

DRAWINGS

The drawings described herein are for illustrative purposes only of selected exemplary embodiments and are not intended to limit the scope of the present disclosure in any way. Similar or identical elements are given consistent reference numerals throughout the various figures.

Reference now will be made to the accompanying drawings in which:

FIG. 2A through 2D show cross-sections of various side zippered sleeping bags incorporating the teachings of the present disclosure;

FIGS. 4A through 4D illustrate a series of different tube blocking baffle configurations applicable for use with the sleeping bags constructed according to the present disclosure;

FIG. 7 shows a cross-section of the top-zippered sleeping bag incorporating the teachings of the present disclosure; and FIGS. 8A and 8B show a sleeper in back and side positions in a top-zippered sleeping bag incorporating the invention.

DETAILED DESCRIPTION

The following exemplary embodiments are provided so that the present disclosure will be thorough and fully convey the scope to those skilled in the art. Numerous specific details are set forth such as examples of specific components, devices and schematic configurations to provide a thorough understanding of exemplary embodiments of the present disclosure. However, it will be apparent to those skilled in the art that these specific details need not be employed, that the exemplary embodiments may be embodied in many different forms, and that neither should be construed to limit the scope of the present disclosure.

Figure 1:
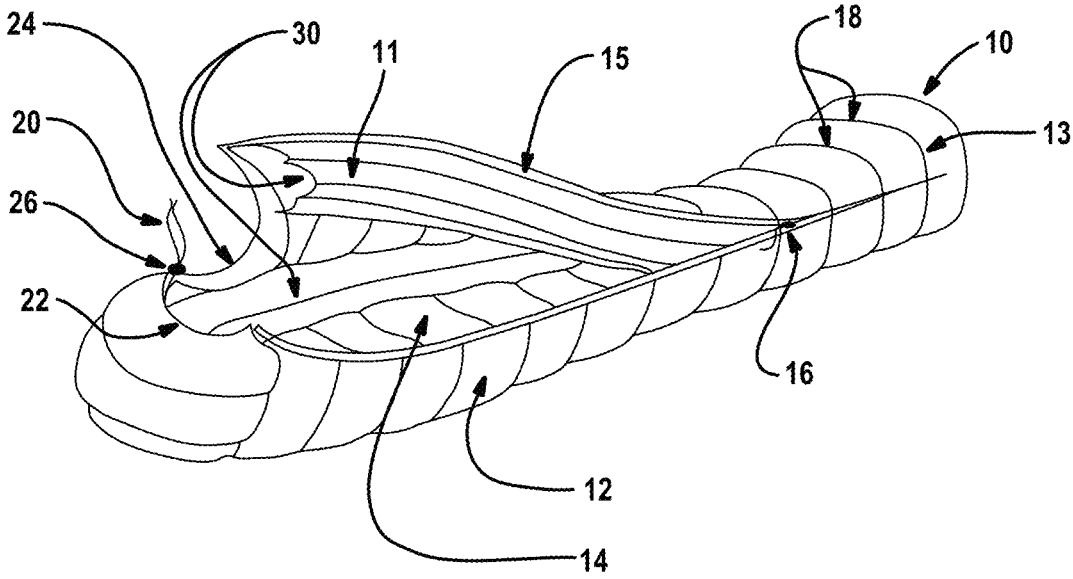
FIG. 1 shows a perspective view of an exemplary side-zippered sleeping bag constructed in accordance with the present teachings.

Referring to FIG. 1, a perspective view of an exemplary sleeping bag 10 constructed in accordance with the present teachings is shown in a partially open position, and may be constructed to have an entrance end, denoted generally by reference numeral 11. The entrance end 11 corresponds to the end of sleeping bag 10 which is intended to receive a user's head and upper body while a lower end 13 corresponds to the end of sleeping bag 10 intended to receive a user's legs and feet. The sleeping bag 10 is generally shown to include an outer shell 12, an inner shell 14, and a closure device such as a zipper assembly 16. As is conventional, light-weight fabrics, such as nylon and polyester, are used for the exterior surfaces defined by outer shell 12 and the interior surfaces defined by inner shell 14. The sleeping bag 10 has a first half 15 and a second half 17 arranged in opposing facing relation so that first half 15 and second half 17 are configured to define a sleeping compartment 19 therebetween when zipper assembly 16 is closed.

As will be detailed hereinafter with reference to FIG. 3, a plurality of internal baffle structures, generally identified by reference numeral 18 and which also made from lightweight man-made materials, are used to locate and maintain an insulating material 36 disposed between outer shell 12 and inner shell 14 in desired positions longitudinally and circumferentially along the length of sleeping bag 10. Baffles 18 are attached to the outer shell 12 and the inner shell 14 by suitable means such as, for example, sewing or adhesives. A drawstring 20 can be used in conjunction with a pair of draw hems 22 and 24 to adjustably vary an opening at the top of sleeping bag 10 once zipper assembly 16 has been drawn to its closed position. A drawstring lock 26 is also provided to maintain the drawstring 20 in a preferred cinched position.

Figure 2A:
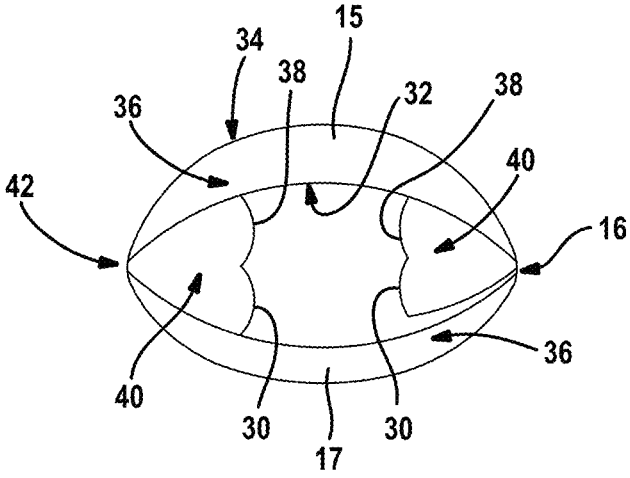
Figure 3B:
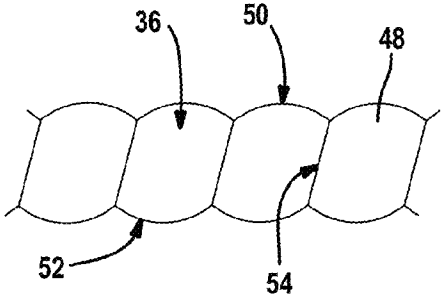
FIGS. 3A through 3D illustrate a series of different internal baffle configurations applicable for use with the sleeping bags constructed according to the present disclosure.
Figure 3D:
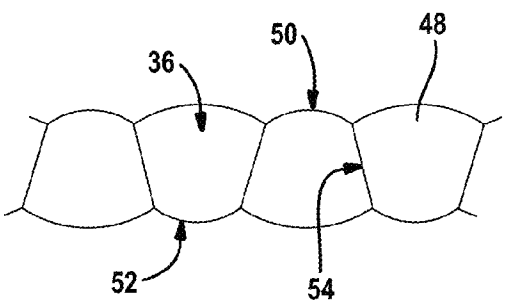
Figure 3A:
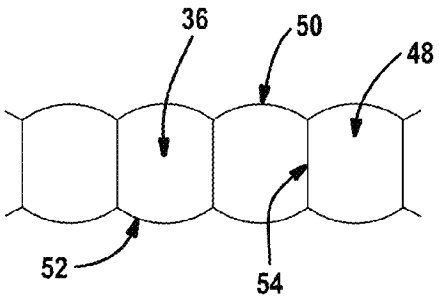
Figure 3C:
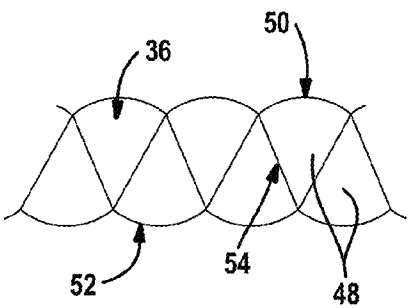

In accordance with one aspect of the present disclosure, sleeping bag 10 is constructed to include one or more insulation containing structures or compartments, in addition to the structures created between the differentially cut inner shell 14 and the outer shell 12, hereinafter referred to as internal space fillers 30, that are integrated into interior sleeping compartment 19 of sleeping bag 10 on at least one lateral side thereof. Referring to FIGS. 2A through 2D, preferred alternative constructions for internal space fillers 30 will now be described based on a series of exemplary cross-sections through sleeping bag 10 generally taken through a typical chest and/or abdominal area of sleeping compartment 19. Mid-side locations for zipper assembly 16 are shown in FIGS. 2A and 2C while low-side locations for zipper assembly 16 are shown in FIGS. 2B and 2D. Regardless of the closure location, all of the sectional views provided by FIG. 2 illustrate that the circumference of an inner surface 32 of inner shell 14 is less than that of an outer surface 34 of outer shell 12 for the full length of sleeping bag 10. This particular configuration is commonly referred to as the "differential" design or cut concept.

As noted, insulation material 36 is retained between outer shell 12 and inner shell 14. Space fillers 30 are defined or delineated by a spacer shell 38 and a portion of inner surface 32 of inner shell 14, and each space filler 30 includes an insulation material 40 disposed within the enclosed compartment or compartments therebetween. Spacer shell 38 is preferably made of a material common to either outer shell 12 and/or inner shell 14 and which is suitably attached to inner surface 32 along its edges to define an enclosed compartment. The most efficient design would be to carry internal space fillers 30 along the entire length of sleeping bag 10. However, it is contemplated that alternative arrangements of one or more space fillers 30 along one or both side wall portions of sleeping bag 10 may be utilized.

Insulation 36 in the first half or top portion 15 of sleeping bag 10 (disposed within transverse insulation compartments 48 between adjacent baffles 18) is kept separate from the insulation 36 in the second half or bottom portion 17 of sleeping bag 10 by an integrated predefined side hinge or edge 42 and zipper assembly 16 (see FIGS. 2A and 2B). As an alternative, insulation 36 retained in particular locations within insulation compartments/tubes 48 formed between the outer and inner shells (whether running transversely or longitudinally) and the baffles 18 can also be accomplished using internal tube-blocking baffles 44, similar to those shown in FIGS. 2C and 2D. Regardless, sleeping bags 10 shown in FIGS. 2A through 2D each include a pair of laterally-spaced internal space fillers 30 that are filled with insulation 40. It will be appreciated that baffles (not shown) similar to baffles 18 can be integrated into each of internal space fillers 30 either transversely or longitudinally or some combination thereof to maintain insulation 40 in desired locations.

FIGS. 3A through 3D show a series of different insulation retention chamber/tubes 48 that may be used with sleeping bag 10. These tubes 48 may run transversely or longitudinally, or any combination thereof relative to the length of sleeping bag 10. Tubes 48 are created between an outer shell material 50, an inner lining material 52 and baffles 18 made from a baffle material 54. Insulation material 36 is inserted into compartments 48 thus formed.

FIGS. 4A through 4C show a series of different types of tube blocking baffles, or in the case of FIG. 4D, no baffle that may be used to control/limit shifting of insulation 36 in insulation retaining space fillers 30 of FIG. 2 and/or insulation retaining chambers/tubes 48 of FIG. 3. These baffles 60 are illustrated to extend between outer shell 12 and inner shell 14 and are perpendicular to the longitudinal direction of the insulation retaining chambers/tubes 48 described in reference to FIG. 3.

Figure 5B:
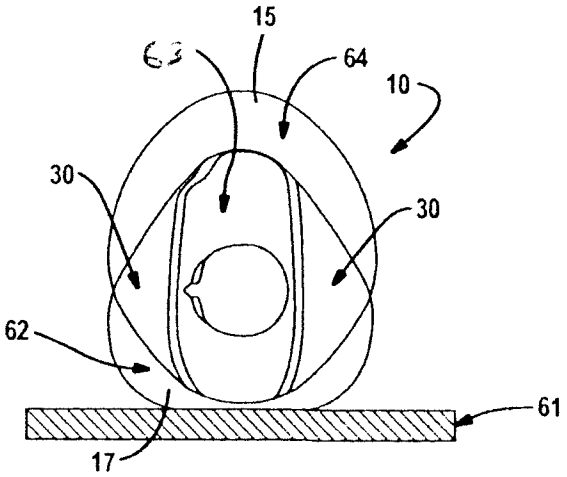
FIGS. 5A and 5B show a sleeper in back and side positions within a side-zippered sleeping bag incorporating the teachings of the present disclosure.
Figure 5A:
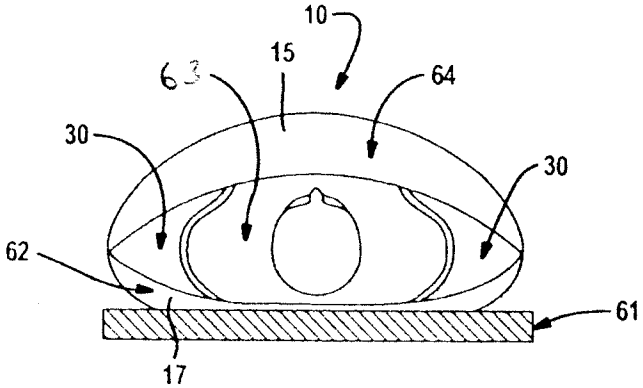

FIGS. 5A and 5B show a sleeper 63 in a side-zippered sleeping bag 10 incorporating various aspects of the present invention. The sleeper 63 and sleeping bag 10 are positioned on a semi-non-compressible pad/mattress 61. Differentially cut lower sleeping bag element 62 and upper sleeping bag element 64, together with space filler elements 30, comprise the invention. FIG. 5 shows that the insulation thickness is maintained and internal spaces/volumes are minimized by integration of space filler elements 30 into sleeping bag 10. This is demonstrated by sleeper 63 on his/her back in FIG. 5A and on his/her side in FIG. 5B.

Figure 6:
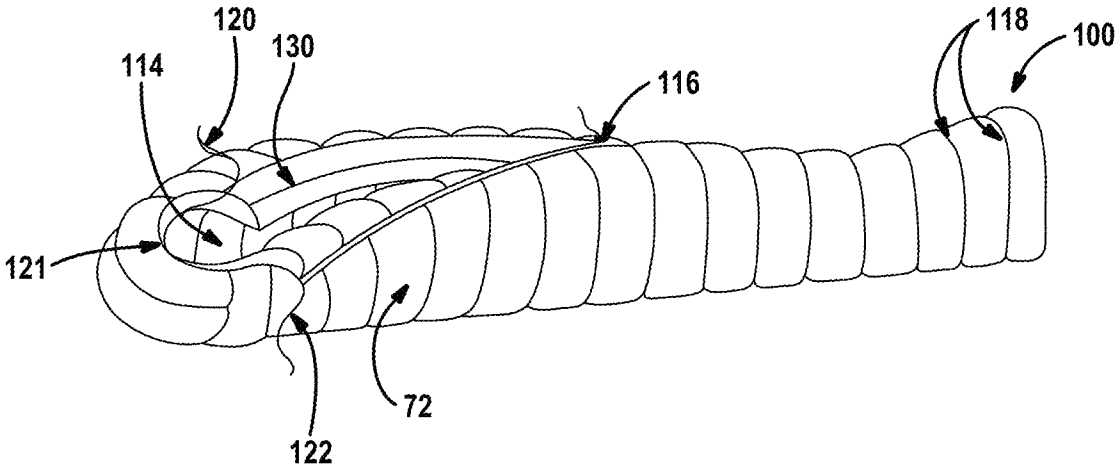
FIG. 6 shows a top-zippered sleeping bag constructed in accordance with the present teachings.

FIG. 6 shows a sleeping bag 100 that incorporates a top closure device, such as a zipper assembly 116. Light-weight fabrics using man made materials, e.g., nylon and polyester, are again used for the exterior surfaces of an exterior shell 112 and the interior surfaces of an inner shell 114. An internal baffle structure 118, also made of lightweight man-made materials, is again used to locate and maintain an insulation material 136 in the desired positions. Details regarding various baffle designs 118 have been previously shown in FIG. 3. As before, baffles 118 are attached by sewing, gluing or other means of attachment to the inner and outer shells. A drawstring 120 is used in conjunction with draw hem 122 to vary an opening 121 at the top of sleeping bag 100 once zipper assembly 116 has been drawn to its closed position. This figure clearly shows an insulation containing structure, or an internal space filler 130, that has been added to the interior sleeping compartment of sleeping bag 100 at the top portion thereof.

FIG. 7 shows the cross-section of the chest and abdominal area of the top-zippered sleeping bag 100 shown in FIG. 6. The sectional view of FIG. 7 shows that the circumference of inner shell 114 is less than that of outer shell 112, whereby the inner circumference is less than the outer circumference for the full length of sleeping bag 100. This again defines the differential design or differential cut configuration. Insulation 136 is retained between outer shell 112 and inner liner 114. Internal space filler element 130 is defined by a spacer shell material 138 and interior surface 132 and further includes an insulation material 140 that is contained between those surfaces. The most efficient design would be to carry space filler element 130 the full length of sleeping bag 100, however, some designs may choose selected locations along the length of the bag. Retaining insulation 136 in a particular location in any insulation tube formed by the outer and inner shells and the interior baffling system (whether running transversely or longitudinally to the long direction of the bag) is also accomplished by using an internal tube-blocking baffle, see FIG. 4. Additional attachment features (i.e., loop and pile, secondary zippers), may be used to aid closure.

FIG. 8 shows a sleeper 63 in a top-zippered sleeping bag 100 incorporating the teachings of the present invention. The sleeper 63 and sleeping bag 100 are positioned on a semi-non-compressible pad/mattress 61. Differentially cut sleeping bag side elements 153 together with space filler element 130 comprise the invention. FIG. 8 shows that insulation thickness is maintained and the internal spaces/volumes are minimized by the present invention. This is demonstrated by sleeper 63 on his/her back in FIG. 8A and on his/her side in FIG. 8B.

It will be appreciated that the particular construction and closure systems disclosed in association with sleeping bags 10, 100 are merely intended to be exemplary. For example, multiple zippers can be used to permit access to the internal sleeping chamber. Likewise, other closure systems such as, for example, loop and pile (VELCRO®) can be used. Furthermore, the internal space filler elements 30, 130 can be releaseably attached via loop and pile attachment systems within the internal sleeping chamber. Accordingly, removeable space filler elements 30, 130 may be "retro-fit" into existing conventional sleeping bags.

While specific aspects have been described in the specification and illustrated in the drawings, it will be understood by those skilled in the art that various changes can be made and equivalents can be substituted for elements and components thereof without departing from the scope of the present teachings, as defined in the claims. Furthermore, the mixing and matching of features, elements, components and/or functions between various aspects of the present teachings are expressly contemplated herein so that one skilled in the art will appreciate from the present teachings that features, elements, components and/or functions of one aspect of the present teachings can be incorporated into another aspect, as appropriate, unless described otherwise above. Moreover, many modifications may be made to adapt a particular situation, configuration, or material to the present teachings without departing from the essential scope thereof. Therefore, it is intended that the present teachings not be limited to the particular aspects illustrated by the drawings and described in the specification as the best mode presently contemplated for carrying out the present teachings, but that the scope of the present teachings include many aspects and examples following within the foregoing description and the appended claims.

What is claimed is:

1. A sleeping bag, comprising:

first and second opposed halves each having an inner shell and an outer shell and the opposed halves defining a sleeping compartment therebetween, an insulating material disposed between the inner shell and the outer shell of the first and second opposed halves, the first and second opposed halves coming together at an apex, a closure device for opening and closing the first and second opposed halves, and a space filler having a triangular cross section with a first corner at the apex and having two sides extending from the first corner to a base extending to a second corner and a third corner defining a base extending between the first and second opposed halves.

2. The sleeping bag of claim 1 wherein the space filler is filled with an insulating material.

3. The sleeping bag of claim 2 wherein the first half is a top half and the second half is a bottom half, and wherein the at least one space filler includes a first space filler connected to the top half within the sleeping compartment.

4. The sleeping bag of claim 3 further comprising a second space filler connected between the top half and the lower half within the sleeping compartment and located in opposing relationship to the first space filler.

5. The sleeping bag of claim 3 wherein the first space filler is located adjacent to the closure device.

6. The sleeping bag of claim 2 wherein the first half is a first side and the second half is a second side of a top-opening sleeping bag, and wherein the at least one space filler includes a first space filler connected to the first side in proximity to the closure device.

7. The sleeping bag of claim 1 wherein first side and said second side extending from said first corner are equal in length.

* * * * *